United States Patent [19]

Germain et al.

[11] Patent Number: 4,923,069

[45] Date of Patent: May 8, 1990

[54] APPARATUS FOR STORING AND DISPLAYING JEWELERY

[76] Inventors: Sylvia Germain; Al Germain, both of R.R. 5, Belleville, Ontario, Canada, K8N 4Z5

[21] Appl. No.: 346,799

[22] Filed: May 3, 1989

[51] Int. Cl.[5] ..... B65D 73/00

[52] U.S. Cl. ..... 211/13; 206/495; 206/566

[58] Field of Search ..... 211/13, 87; 223/109 R; 206/495, 566

[56] References Cited

U.S. PATENT DOCUMENTS

| | | | |
|---|---|---|---|
| 3,622,010 | 11/1971 | Renelt | 211/13 |
| 4,181,224 | 1/1980 | Aber . | |
| 4,561,574 | 12/1985 | Brown | 223/109 R |
| 4,573,585 | 3/1986 | Frei | 211/13 |
| 4,606,458 | 8/1986 | LaBate . | |
| 4,687,103 | 8/1987 | Corbett | 211/13 X |
| 4,690,537 | 5/1978 | Bollman | 223/109 R |
| 4,767,011 | 8/1988 | Butler | 211/13 |
| 4,821,883 | 4/1989 | Miller | 206/566 X |
| 4,848,586 | 7/1989 | Jasik | 206/495 X |

FOREIGN PATENT DOCUMENTS 739303 7/1966 Canada .

*Primary Examiner*—Robert W. Gibson, Jr.
*Attorney, Agent, or Firm*—Nixon & Vanderhye

[57] ABSTRACT

An apparatus for displaying or storing jewelery, comprising in combination a support means and successive layers of spacing means, a backing and a retention medium.

10 Claims, 3 Drawing Sheets

APPARATUS FOR STORING AND DISPLAYING JEWELERY

This invention relates to apparatus for displaying and/or storing earrings, pins, brooches and similar jewelry.

It has been known in the art of jewelry display apparatus to provide means for displaying and mounting buttons or other collectible items which have apertures or an opening for receiving a tying device. Canadian patent No. 739,303, which issued July 26, 1966 to Howard S. Thomas, disclosed a mounting and display board for such items. The Thomas device comprised a backing sheet having reference markings on the back thereof and a cushioning pad secured to the front of the backing sheet. The rear of the backing sheet is provided with flexible wire strips in accordance with the reference margins. The cushioning pad is pierced by tie means which extend through the cushioning pad and are secured to the flexible wire strips. The other end of the tie means protrude at the front of the cushioning pad. The device is used by tying the tie means about the apertures of the jewelry on the front of the apparatus thereby pressing the item of jewelry against the cushioning pad and the backing sheet.

It is also known in the art to provide the apparatus for mounting and displaying jewelry having a post configurations. U.S. Pat. No. 4,606,458 which was issued Aug. 19, 1986 to Liza V. LaBate disclosed such a device for positioning and holding jewelry having a post configuration. The invention disclosed in the LaBate patent comprises a wire mesh screen stretched over a suitable frame. The post of an earring or similar jewelry is inserted into the wire mesh and is retained by the friction between the post and the wire mesh.

U.S. Pat. No. 4,181,224 which issued Jan. 1, 1980 to Dick Aber discloses yet another apparatus for holding pierced earrings for display and/or storage. The Aber patent describes apparatus which includes a base, a filler material, a first layer of plastic sheet disposed over the filler material, a second layer of filler disposed over the first layer of plastic sheet, and an outermost layer of plastic sheet disposed over the middle sheet of filler. Several holes are provided in the first layer of plastic sheet. Further holes are provided in the second layer of plastic sheet and are aligned with the holes on the first layer of plastic sheet. The post of the earring is inserted through the holes in the plastic sheets and through the filler material. According to the Aber patent, the retention of the post is achieved by the frictional forces between the post on the one hand, and the layers of plastic sheet and filler material on the other hand.

In order for the Aber invention to be put into practice, very careful manufacturing to precise tolerances would be necessary in order to achieve the alignment of holes required to allow the easy insertion of the post of jewelry. In addition, the repeated friction against the plastic sheet is likely to result in stretching the deformation thereby reducing the friction available between the sheets and the post of the jewelry.

Moreover, the need to insert the post along the cooperating holes renders the Aber device inoperative for jewelry having a curved post or pin configurations.

OBJECT OF THE INVENTION

It is an object of this invention to provide an apparatus which is suitable for holding and/or storing jewelry with a post configuration wherein the jewelry may be releasably engaged in the apparatus and removed therefrom upon application of a positive withdrawing force.

It is a further object of this invention to provide such apparatus wherein a user may insert the post of the jewelry at any location on the surface of the apparatus, notably without the need to coincide the position of the post with holes or the like.

It is yet a further object of this invention to provide such apparatus which may be used to retain jewelry not only with a straight post, but also with a curved post or pin configuration.

It is a further object of this invention to provide such apparatus wherein an item of jewelry comprising a post and a removable butterfly portion may be releasably engaged in the apparatus with the butterfly attached to the post.

It is a further object of this invention to provide such apparatus which is simple in its construction and which may be manufactured at minimal cost.

DESCRIPTION OF THE INVENTION

We have found that the provision in combination of a suitable retention medium, backing material and spacing means as described below can be used to achieve the above stated objects.

The invention comprises substantially a surface layer of a retention medium, a backing to support the surface layer against piercing pressure and a low density medium (spacing means) behind the backing layer. The retention medium should have sufficient density such that, once pierced by the post, the post will be retained in the medium unless intentionally withdrawn by the user. The medium must substantially readhere to itself once the post is removed so as to allow the repeated insertion and retention in the same location of items of jewelry. We have found that certain foam-like substances have such characteristics but that they also have a fairly high surface tension and compressibility which, when combined, result in a resistance to piercing. A backing material of sufficient rigidity to support the retention medium against piercing pressure is provided. Such backing is made of a pierceable material to allow the post to be driven past the point of maximum compression of the retention medium and through the backing thereby overcoming the surface tension of the retention medium and piercing it. Finally, a lower density medium is provided behind the backing material and into which the piercing point of the post may protrude from the backing. This provides the followthrough necessary to completely pierce the retention medium.

More particularly, the invention comprises an apparatus for displaying or storing jewelry having a post, comprising in combination a support means and successive layers of a spacing means, a backing and a retention medium, wherein:

said support means are adapted to have said successive layers mounted thereupon;

said spacing means is in abutting relationship with said support means and include means for maintaining a space between said support means and said backing;

said backing comprises a layer of rigid pierceable material having a first and second sides, said first side abutting said spacing means;

said retention medium is in abutting relationship with said second side of said layer of rigid pierceable material, said retention medium being compressible and having a point of maximum compression, said retention medium further having suitable surface tension characteristics to resist piercing by the said post except when the said post is driven past the said point of maximum compression and having suitable density and adhesion characteristics such that once pierced by the said post, the retention medium will retain said post in said retention medium until the said post is intentionally disengaged.

DESCRIPTION OF THE PREFERRED EMBODIMENT

The features of the invention may be more fully appreciated by reference to the detailed description of the preferred embodiment and to the drawings thereof wherein.

Figure 1:
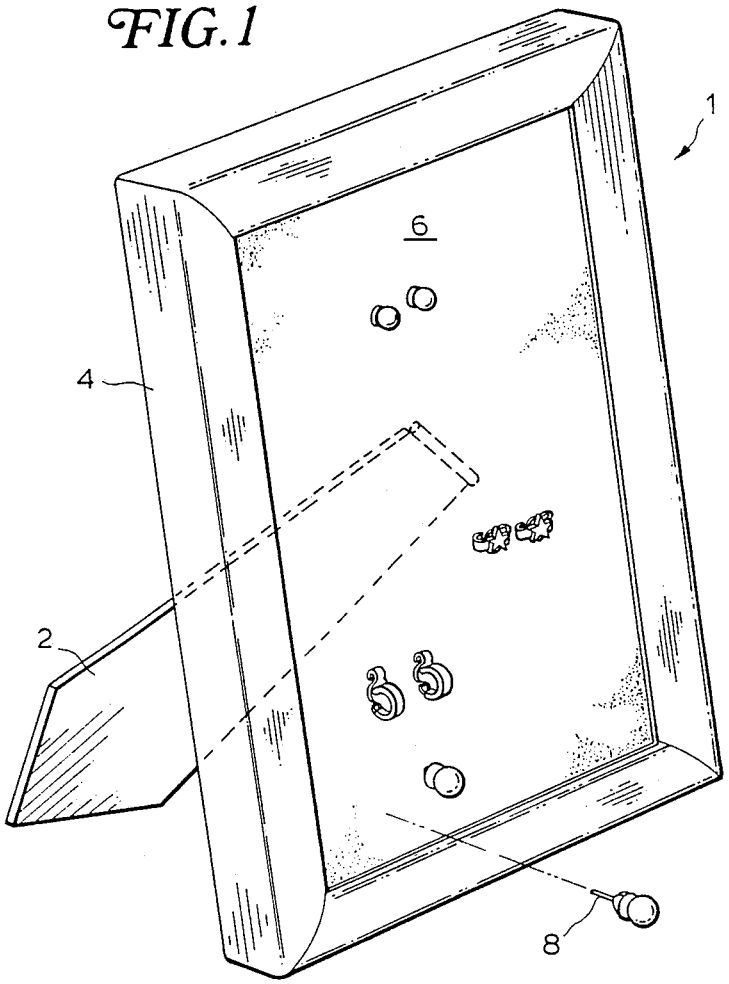
FIG. 1 is perspective view of the preferred embodiment of the invention.

FIG. 1 illustrates the preferred embodiment of the invention wherein a jewelry display unit 1 includes a stand 2 and a rectangular frame 4. Retention of jewelry in the display unit is by means of a composite layered material 6, more particularly described below, into which the post 8 of jewelry having a post configuration may be inserted.

Figure 2:
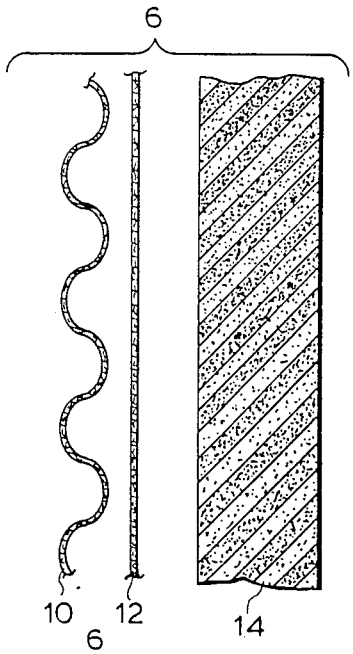
FIG. 2 is an exploded sectional side view of the preferred embodiment of the invention providing detail of the construction thereof.

Referring more particularly to FIG. 2, the composite layered material 6 comprises spacing means 10, a layer of backing 12, and a retention medium 14.

The retention medium 14 is presented to the front of the display unit 1 and is therefore suitable for colouring or dyeing so that the display unit 1 presents an esthetically pleasing outward appearance. The retention medium 14 is resiliently compressible with sufficient surface tension to resist piercing unless the post 8 is driven past the point of maximum compression of the retention medium 14. The retention medium has a sufficiently high density to frictionally retain the post 8 once the retention medium 14 has been pierced, and has the ability to readhere to itself once the post 8 is removed therefrom. In the preferred embodiment of our invention, such retention medium is polyurethane, semi-open cell, ether-based foam having a nominal density of 2.2 lbs per cu. foot and a nominal indentation force deflection of 32 lbs per 50 sq. inches.

Figure 4:
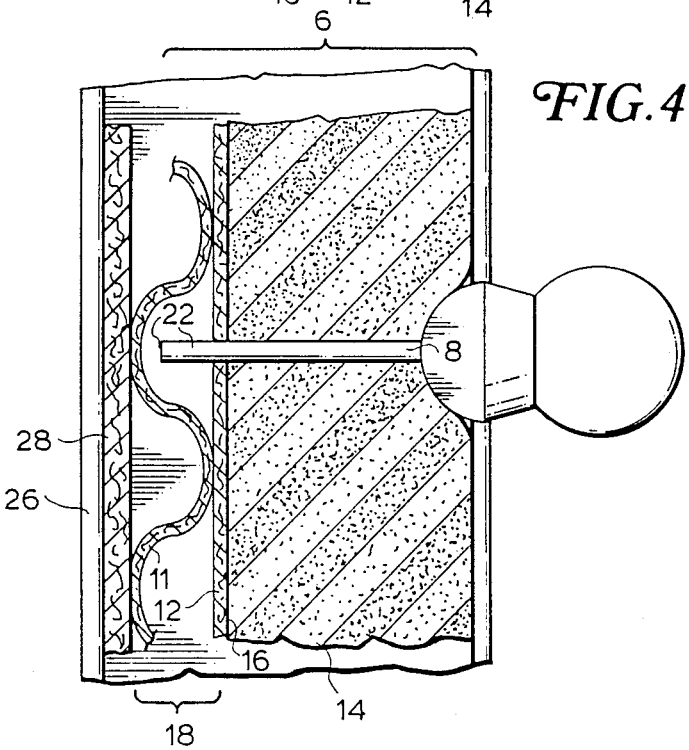
FIG. 4 is a sectional side view of the preferred embodiment of the invention wherein an earring has pierced the retention medium and is retained in the apparatus.
Figure 3:
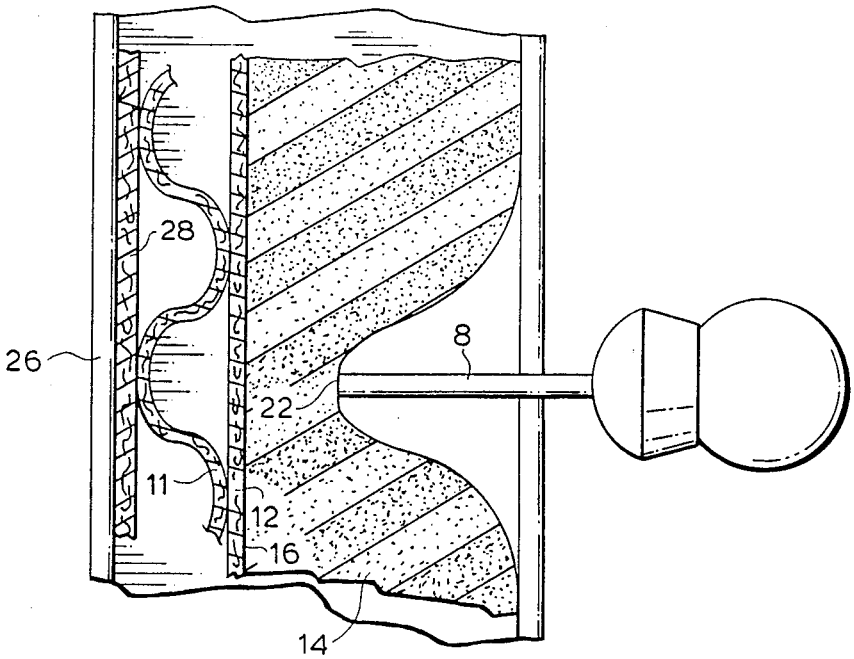
FIG. 3 is a sectional view of the preferred embodiment of the invention wherein the post of an earring has compressed the retention medium near the point of maximum compression thereof.

A layer of backing material 12 is disposed against the back 16 of the retention medium 14. This layer of backing material 12 is sufficiently rigid to provide a surface against which the post 8 may compress the retention medium 14. The backing material is piercable thereby allowing the post 8 to follow through the retention medium 14 past the point of maximum compression thereof and to thereby overcome the surface tension of the retention medium 14 as illustrated in FIG. 4.

In the preferred embodiment of the invention, the spacer 10 consists of the flute portion of a single-faced corrugated liner 18, and the backing 12 consists of the flat linerboard sheet of the single-faced corrugated liner 18. The flute portion provides the spacing means by which the post 8 of the pin may pierce through the retention medium 14, the backing 12 and therebeyond. Once pierced as described above, the retention medium 14 retains the post 8 of the jewelry therein by virtue of the high density and adhesion characteristics of the retention medium. Accordingly, it may be appreciated that jewelry may be urged against the retention medium 14 at any location thereon with sufficient force to pierce the retention medium 14 and the backing 12 and to make the inner end 22 of the post 8 protrude past the backing 12 and into the spacer 10 as illustrated in FIG. 4. When it is desired to remove the jewelry from the display unit, the user will apply sufficient outward pulling force to the jewelry to overcome the frictional forces of the retention medium 14. Once removed, the high density and adhesion characteristics will allow the retention medium 14 to readhere around the point of the insertion of the post 8, thus enabling successive reinsertion and removal of jewelry items at that same location.

In the preferred embodiment of the invention, a frame 4 is adapted to maintain the retention medium 14, the backing 12 and the spacer 10 in operative relationship. The frame 4 consists of a rigid rectangular border formation 26 and a rigid back 28. The rigid back 28 provides a rigid surface against which the layered materials may be mounted and held.

It will be appreciated by those skilled in the art that the invention will be equally useful for earrings, brooches, and other jewelry having not only straight or post-like configuration but also curved post configuration wherein the tip of the curved post is inserted against the retention medium until piercing thereof is achieved.

It will also be appreciated by those skilled in the art that variations to the preferred embodiment described herein may be made without departing from the invention. Notably, the frame described and illustrated in the preferred embodiment might be substituted by any suitable support means for the successive layers of the invention and such support means may be of arbitrary shape or configuration.

What I claim is:

1. Apparatus for displaying or storing jewelry having a post comprising in combination support means and successive layers of a spacing means, a backing and a retention medium, wherein:

said support means are adapted to have said successive layers mounted thereupon;

said spacing means is in abutting relationship with said support means and includes means for maintaining a space between said support means and said backing;

said backing comprises a layer of rigid pierceable material having a first and second sides, said first side abutting said spacing means;

said retention medium is in abutting relationship with said second side of said layer or rigid pierceable material, said retention medium being compressible and having a point of maximum compression, said retention medium further having suitable surface tension characteristics to resist piercing by the said post except when the said post is driven past the said point of maximum compression and having suitable density and adhesion characteristics such that once pierced by the said post, the retention medium will retain said post in said retention medium until the said post is intentionally disengaged.

2. Apparatus as in claim 1 wherein the combination of said backing and said spacing means consist of a single-faced corrugated linerboard comprising a fluted corrugated portion in secured abutting relationship with a flat portion, and wherein said backing consists of said flat portion and said spacing means consist of said fluted corrugated portion.

3. Apparatus as in claim 1, wherein said retention medium consists of flexible polyurethane semi open cell ether based foam having nominal density between 1.7 and 3.0 pounds per cubic foot and nominal indentation force deflection of between 25 and 40 pounds per 50 square inches.

4. Apparatus as in claim 2, wherein said retention medium consists of flexible polyurethane semi open cell ether based foam having nominal density between 1.7 and 3.0 pounds per cubic foot and nominal indentation force deflection of between 25 and 40 pounds per 50 square inches.

5. Apparatus as recited in claim 1 wherein said retention medium comprises a foam having a density between 1.7 and 3.0 pounds per cubic foot, and nominal indentation force deflection of between 25 and 40 pounds per 50 square inches.

6. Apparatus as recited in claim 2 wherein said retention medium comprises a foam having a density between 1.7 and 3.0 pounds per cubic foot, and nominal indentation force deflection of between 25 and 40 pounds per 50 square inches.

7. Apparatus as recited in claim 1 wherein said retention medium comprises a flexible polyurethane semi open cell ether based foam.

8. Apparatus as recited in claim 2 wherein said retention medium comprises a flexible polyurethane semi open cell ether based foam.

9. Apparatus as recited in claim 1 wherein said retention medium comprises a material having a nominal density of about 2.2 pounds per cubic foot, and a nominal indentation force deflection of about 32 pounds per 50 square inches.

10. Apparatus as recited in claim 2 wherein said retention medium comprises a material having a nominal density of about 2.2 pounds per cubic foot, and a nominal indentation force deflection of about 32 pounds per 50 square inches.

* * * * *